US005685166A

United States Patent [19]

Li

[11] Patent Number: 5,685,166

[45] Date of Patent: Nov. 11, 1997

[54] MAINFRAME OF AN AIR CONDITIONER

[76] Inventor: Chen Tze Li, P.O. Box 82-144, Taipei, Taiwan

[21] Appl. No.: 598,025

[22] Filed: Feb. 7, 1996

[51] Int. Cl.[6] ..... F25D 17/06

[52] U.S. Cl. ..... 62/428; 62/259.1

[58] Field of Search ..... 62/404, 426, 428, 62/259.1, 262, 263

[56] References Cited

U.S. PATENT DOCUMENTS 2,155,831 4/1939 Hull ..... 62/428

4,911,234 3/1990 Heberer et al. ..... 62/259.1

*Primary Examiner*—John M. Sollecito

*Attorney, Agent, or Firm*—Alfred Lei

[57] ABSTRACT

An air conditioner mainframe which includes a base frame having a compressor chamber and a condenser chamber separated by an air intake passage, a shell covered on the front side of the base frame and having an air outlet, a condenser mounted in the condenser chamber around the border, a compressor mounted in the compressor chamber, a fan mounted in an upright fan support inside the condenser chamber, and a top cover covered on the top side of the base frame, wherein the base frame has a plurality of recessed portions at the bottom side around the border, the top cover has a plurality of raised portions at the top side around the border corresponding to the recessed portions of the base frame for permitting a plurality of air conditioner mainframes of the same structure to be connected in a stack by fitting the raised portions of the top cover of one mainframe into the recessed portions of the base frame of another.

5 Claims, 4 Drawing Sheets

MAINFRAME OF AN AIR CONDITIONER

BACKGROUND OF THE INVENTION

1. Field of the Invention

This invention relates to air conditioners, and relates more particularly to the mainframe of an air conditioner which permits a plurality of mainframes of the same structure to be conveniently connected in a stack.

2. Description of the Prior Art

The shapes and sizes of the mainframes of conventional air conditioners vary with the models, therefore the housing of the mainframes are not inter-exchangeable. However, it is not economic to prepare various housings of different specifications for air conditioners of different models. The mainframe of a regular air conditioner, as shown in FIG. 1, is generally comprised of a flat base frame 71, a substantially L-shaped condenser 7 mounted on the flat base frame 71 at one side, a compressor 72 mounted on the base frame 71 far away from the condenser 73, and a fan 74 mounted on the flat base frame 71 and spaced between the condenser 73 and the compressor 72. One drawback of this structure of mainframe is that the capacity of the mainframe is not changeable when set. Another drawback of this structure of mainframe is that the L-shaped condenser 73 acts only at two adjacent sides, therefore the heat exchanging efficiency is low.

SUMMARY OF THE INVENTION

This invention is designed to provide an air conditioner mainframe which permits a plurality of mainframes of the same structure to be conveniently connected in a stack. According to one aspect of the present invention, the air conditioner mainframe comprises a base frame having a compressor chamber and a condenser chamber separated by an air intake passage, a shell covered on the front side of the base frame and having an air outlet, a condenser mounted in the condenser chamber around the border, a compressor mounted in the compressor chamber, a fan mounted in an upright fan support inside the condenser chamber, and a top cover covered on the top side of the base frame, wherein the base frame has a plurality of recessed portions at the bottom side around the border, the top cover has a plurality of raised portions at the top side around the border corresponding to the recessed portions of the base frame for permitting a plurality of air conditioner mainframes of the same structure to be connected in a stack by fitting the raised portions of the top cover of one mainframe into the recessed portions of the base frame of another. According to another aspect of the present invention, the condenser chamber is defined by a slotted, substantially U-shaped upright partition wall, and the condenser has a substantially U-shaped profile closely attached to the U-shaped upright partition wall to effectively perform a heat exchanging process.

DETAILED DESCRIPTION OF THE PREFERRED EMBODIMENT

Figure 1:
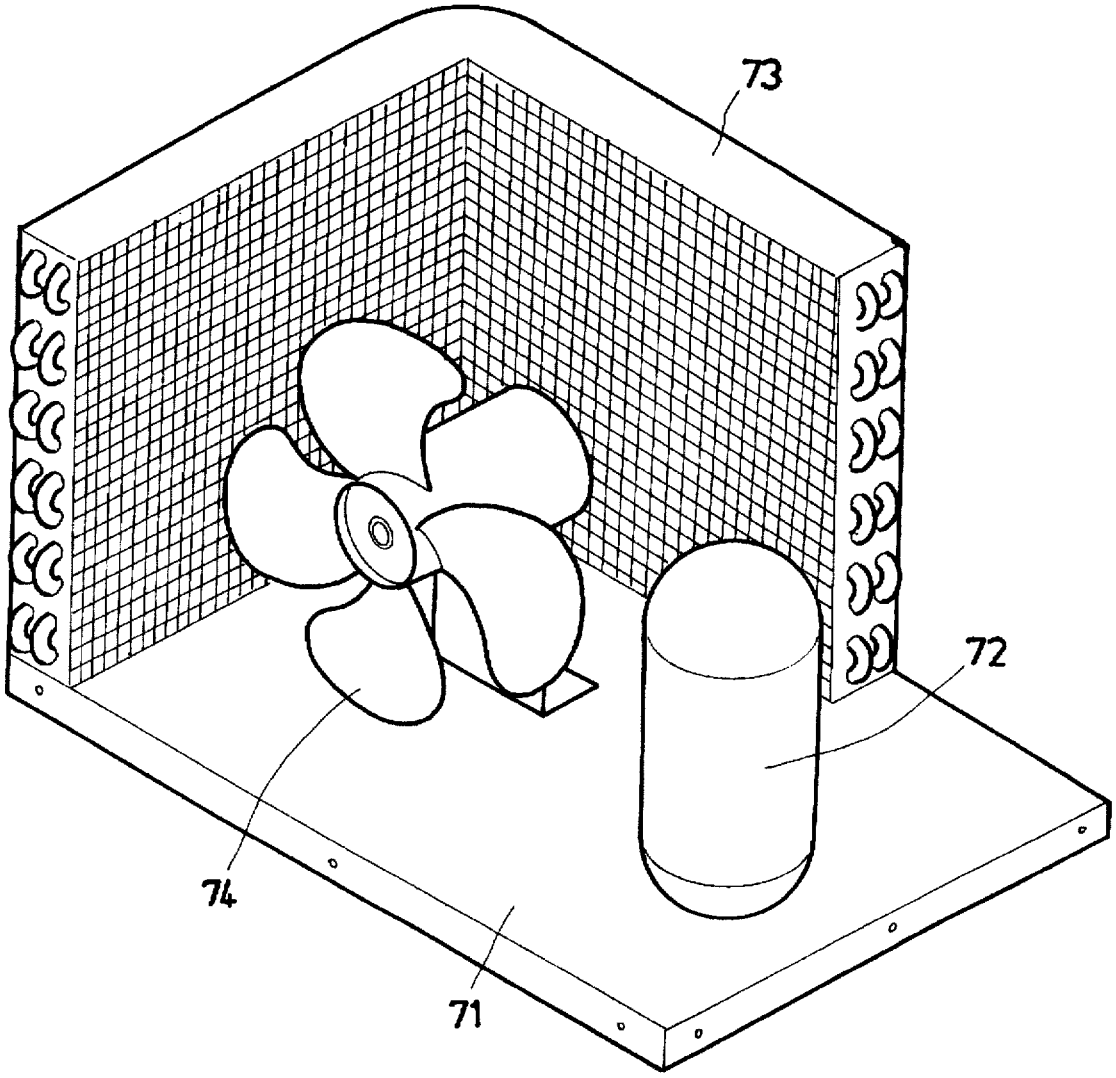
FIG. 1 is a cutaway of the mainframe of a conventional air conditioner.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
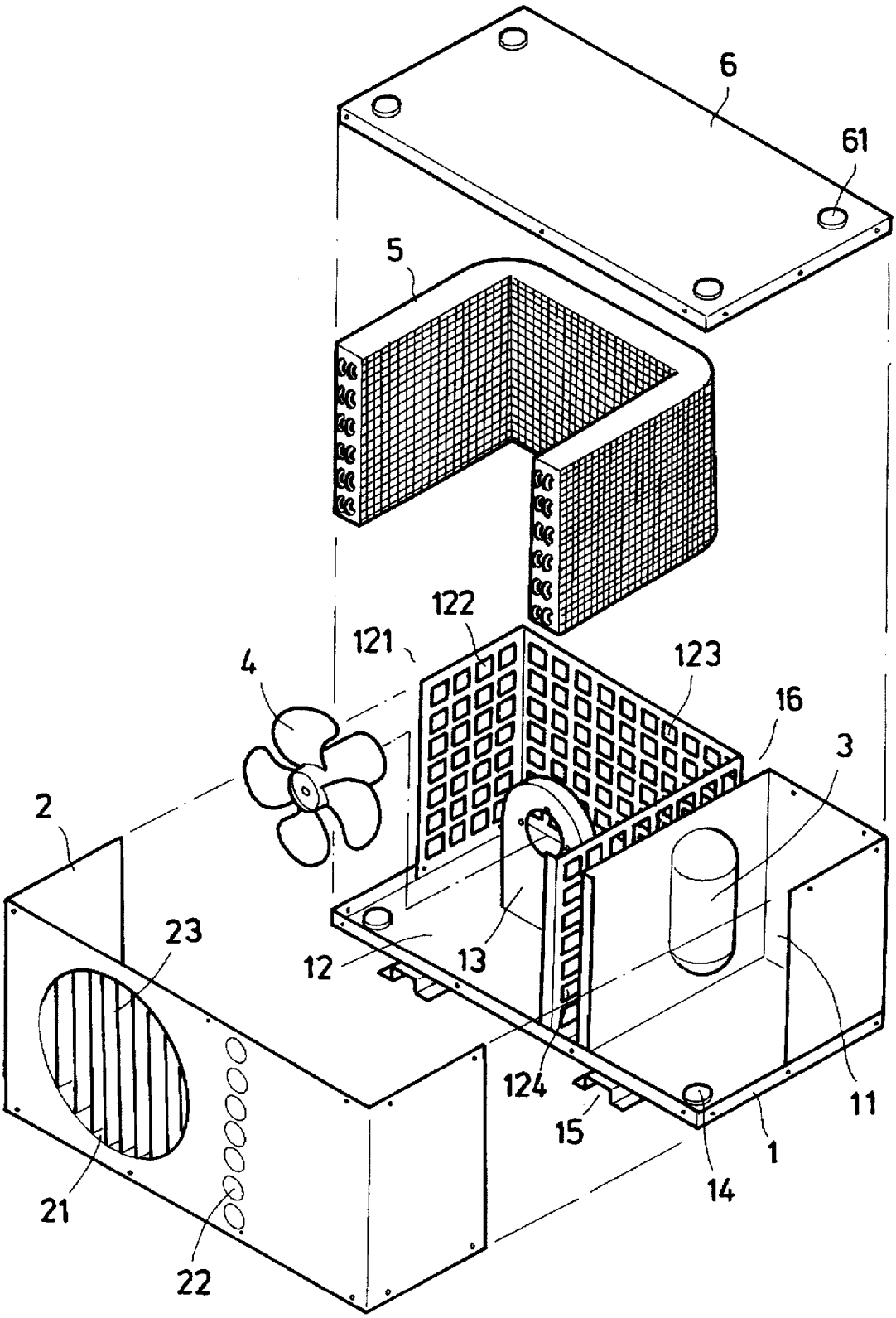
FIG. 2 is an exploded view of the mainframe of an air conditioner according to the present invention.

Referring to FIG. 2, the present invention comprises a base frame 1, a shell 2, a compressor 3, a fan 4, a condenser 5, and a top cover 6. The base frame 1 comprises a first partition wall 111 defining a compressor chamber 11, a second partition wail 121 defining a condenser chamber 12, an air intake passage 16 of width about 30–50 mm defined between the compressor chamber 11 and the condenser chamber 12. The first partition wall 121 comprises a left side wall portion 122 and a right side wall portion 124 bilaterally disposed in a parallel relation, and a back side wall portion 123 connected between the left side wall portion 122 and the right side wall portion 124. The side wall portions 122, 123, 124 are respectively slotted for permitting air to pass. An upright fan support 13 is disposed at the center of the condenser chamber 12. The base frame 1 further comprises a plurality of recessed portions 14 at the bottom side around the border, and a plurality of mounting frames 15 at the bottom side. The shell 2 is covered on the front side of the base frame 1, having a substantially U-shaped profile, an air outlet 21 corresponding to the upright fan support 13, a plurality of louvers 23 mounted in the air outlet 21 for regulating the direction of outward air passing through, and a plurality of vertically spaced air intake holes 22 aligned with the air intake passage 16. The compressor 3 is fixedly mounted inside the compressor chamber 11. The capacity of the compressor 3 is determined subject to actual requirement. The fan 4 is mounted on the upright fan support 13 inside the condenser chamber 12, and controlled to flow air toward the air outlet 21 of the shell 2. The condenser 5 has a substantially U-shaped profile closely attached to the left side wall portion 122, back side wall portion 123, and right side wall portion 124 of the second partition wall 1121. The top cover 6 is a flat cover plate covered on base frame 1 at the top side, having a plurality of raised portions 61 raised from the top side around the border corresponding to the recessed portions 14 of the base frame 1.

Figure 3:
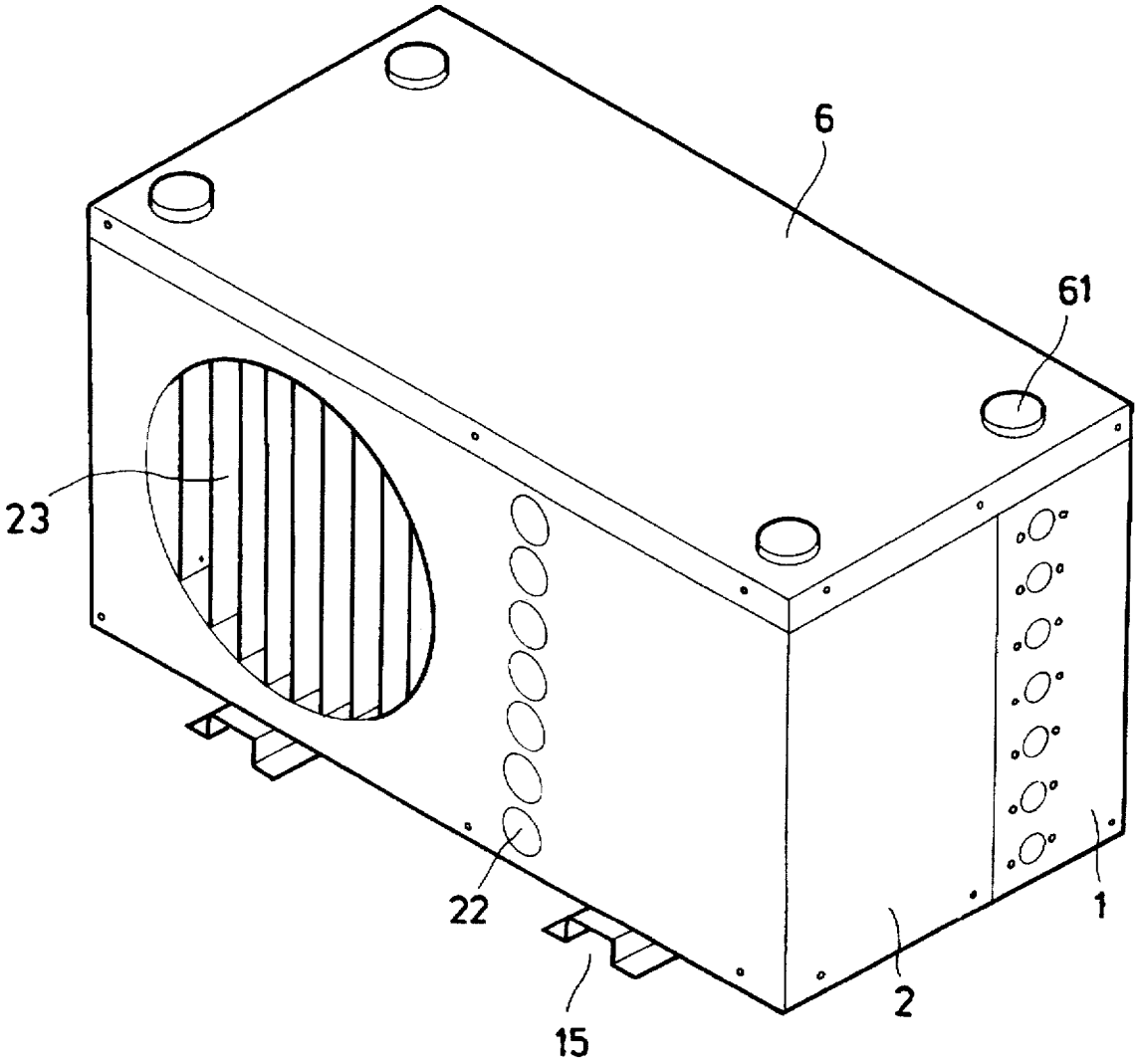
FIG. 3 is an elevational view of the mainframe shown in FIG. 2.

Referring to FIG. 3 and FIG. 2 again, the compressor 3 and the condenser 5 are respectively fastened to the compressor chamber 11 and the condenser chamber 12, then the fan 13 is fastened to the upright fan support 13, and then the shell 2 is covered on the front side of the base frame 1, permitting the air outlet 21 and the air intake holes 22 to be aligned with the fan 4 and the air intake passage 16 respectively, and then the top cover 6 is covered on the top side of base frame 1 to close the compressor chamber 11 and the condenser chamber 12. When the compressor 3 is operated, high pressure cooling agent is forced to circulate through the condenser 5 and to make a heat exchange, and at the same time the fan 4 is operated to draw outside air into the condenser chamber 12 through the air intake holes 22, the air intake passage 16, and the slotted side wall portions 122, 123, 124, and to drive cool air out of the condenser chamber 12 through the air outlet 21.

Figure 4:
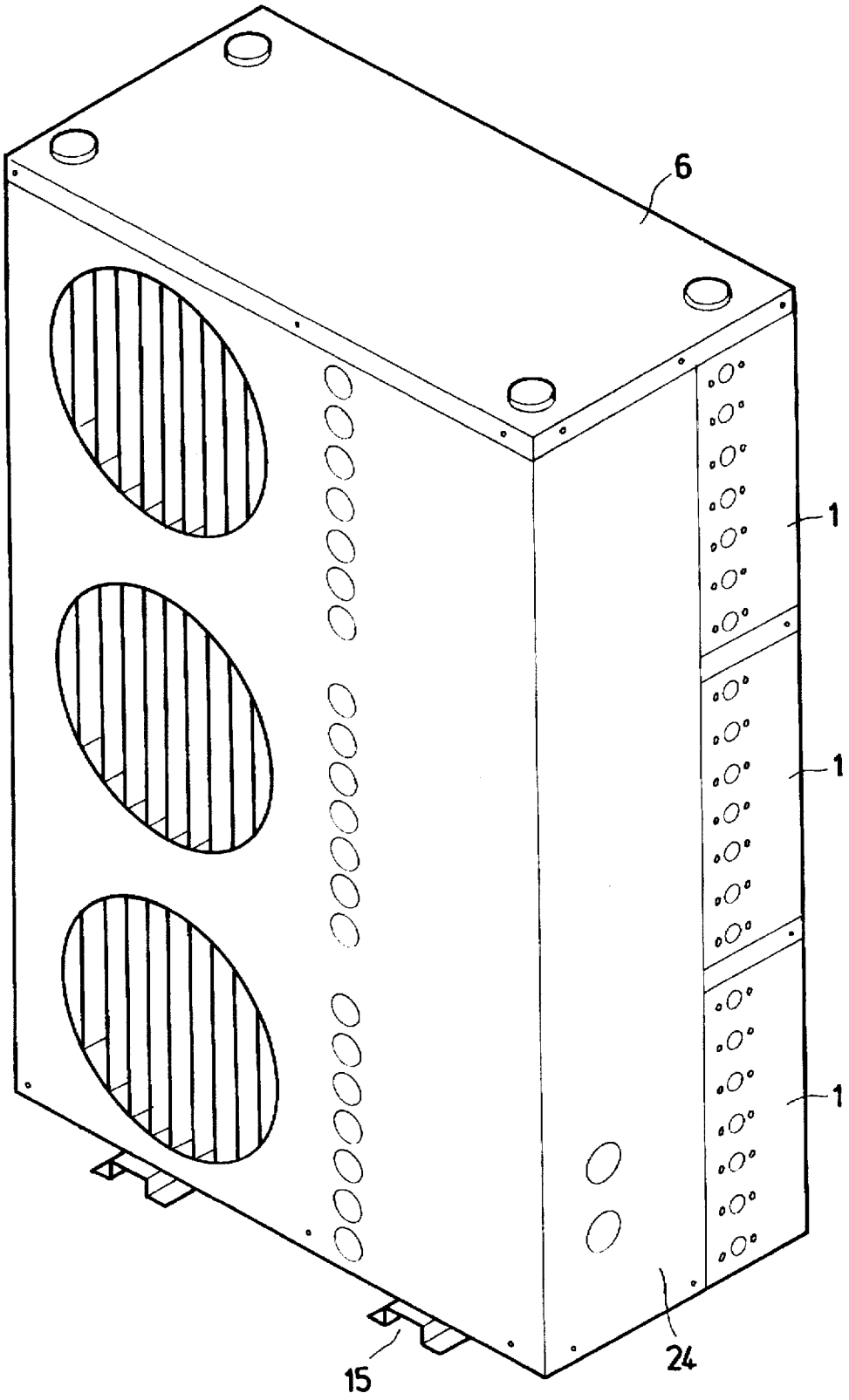
FIG. 4 shows a plurality of mainframes connected in a stack according to the present invention.

Referring to FIG. 4 and FIG. 2 again, a plurality of mainframes can be connected in a stack by fastening the raised portions 61 of the top cover 6 of a lower mainframe to the recessed portions 14 of the base frame 1 of an upper mainframe. Of course, before fastening two mainframes in a stack, the mounting frames 15 of the upper mainframe must be removed so that the respective raised portions 61 can be fastened to the respective recessed portions 14.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air conditioner mainframe comprising:

a base frame having a compressor chamber and a condenser chamber respectively defined by a first partition wall and a second partition wall, an air intake passage defined between said first partition wall and said second partition wall, and an upright fan support disposed inside said condenser chamber, said compressor chamber and said condenser chamber having a respective front opening and a respective top opening, said second partition wall being slotted;

a shell fastened to said base frame and covered over the front openings of said compressor chamber and said condenser chamber, having an air outlet;

a condenser having a substantially U-shaped profile mounted inside said condenser chamber and closely attached to said second partition wall;

a compressor fixedly mounted inside said compressor chamber and controlled to compress a cooling agent through said condenser for heat exchange;

a fan mounted on said upright fan support and controlled to draw outside air through said second partition wall and said air intake passage into said condenser chamber for heat exchange with said condenser and to drive cool air out of said condenser chamber through the air outlet of said shell; and a top cover fastened to said base frame and covered the top openings of said compressor chamber and said condenser chamber.

2. The air conditioner mainframe as claimed in claim 1 wherein said base frame has a plurality of recessed portions at a bottom side thereof around the border, said top cover has a plurality of raised portions at a top side thereof around the border corresponding to the recessed portions of said base frame for permitting a plurality of air conditioner mainframes of the same structure to be connected in a stack by fitting the raised portions of the top cover of one mainframe into the recessed portions of the base frame of another.

3. The air conditioner mainframe as claimed in claim 1 wherein said shell has a row of vertically spaced air intake holes aligned with the air intake passage of said base frame.

4. The air conditioner mainframe as claimed in claim 1 wherein the air outlet of said shell is mounted with a plurality of louvers.

5. The air conditioner mainframe as claimed in claim 1 wherein said base frame has a plurality of mounting frames at a bottom side thereof for mounting.

* * * * *